United States Patent [19]

Husted

[11] 4,322,833

[45] Mar. 30, 1982

[54] ELECTRONIC TIMEPIECE HAVING CONDUCTIVE FACE COVER FOR IMPLEMENTING DISPLAY FUNCTION

[75] Inventor: Jack E. Husted, Garland, Tex.

[73] Assignee: Micro Display Systems, Inc., Dallas, Tex.

[21] Appl. No.: 794,742

[22] Filed: May 9, 1977

[51] Int. Cl.[3] ..... G04C 17/00; G04C 19/00

[52] U.S. Cl. ..... 368/69; 368/321; 307/116

[58] Field of Search ..... 58/23 R, 23 BA, 50 R, 58/88 R; 200/52 R, 159 R, DIG. 1, DIG. 2; 307/116; 368/69–71, 185–188, 319–321

[56] References Cited

U.S. PATENT DOCUMENTS

| | | | |
|---|---|---|---|
| 3,879,618 | 4/1975 | Larson | 307/116 |
| 3,943,696 | 3/1976 | Portmann et al. | 58/23 R |
| 3,975,899 | 8/1976 | Haber | 58/88 R |
| 3,983,690 | 10/1976 | McClintock | 58/50 R |
| 3,992,873 | 11/1976 | Awalt | 58/50 R |
| 4,047,010 | 9/1977 | Derotto et al. | 235/156 |
| 4,048,796 | 9/1977 | Sasaki | 58/23 R |
| 4,055,755 | 10/1977 | Nakamura et al. | 364/705 |
| 4,059,956 | 11/1977 | Maeda et al. | 58/23 R |
| 4,063,111 | 12/1977 | Dobler et al. | 307/116 |
| 4,064,688 | 12/1977 | Sasaki et al. | 58/50 R |

*Primary Examiner*—Vit W. Miska

*Attorney, Agent, or Firm*—Hubbard, Thurman, Turner, Tucker & Glaser

[57] ABSTRACT

An electronic timepiece including timekeeping means, an electro-optical time display, and a circuit for setting the display is disposed within an electrically conductive case and an electrically conductive, optically transmissive face cover. A battery is coupled to energize the timekeeping means continuously and the display setting circuit selectively. The electrically conductive face cover and the electrically conductive case are insulated from one another and constitute electrodes of a switching circuit for selectively connecting the battery to energize the display circuit. The battery is electrically connected in series with the conductive case and display circuit, and the display circuit is electrically connected in series with the conductive face cover and battery, whereby the display circuit may be selectively energized by simultaneously contacting the exterior conductive surfaces of the face cover and case with a conductive body disposed outside of the case. The display circuit is operably responsive to a predetermined current range corresponding generally to the magnitude of the current conducted by the battery through the body of a person wearing the timepiece. A person wearing the timepiece with the conductive case disposed in electrical contact with the skin of his wrist or some other part of his body can actuate the display circuit by touching an accessible exterior conductive surface portion of the face cover with his finger or with some other part of his body.

3 Claims, 11 Drawing Figures

ELECTRONIC TIMEPIECE HAVING CONDUCTIVE FACE COVER FOR IMPLEMENTING DISPLAY FUNCTION

BACKGROUND OF THE INVENTION

1. Field of the Invention

The present invention relates generally to an electronic timepiece having an electro-optical display and, more particularly, to an improved switching arrangement which employs no moving parts for actuating the display.

2. Description of the Prior Art

Electronic timepieces such as electronic wrist watches are well known in the art. A typical electronic timepiece includes a crystal-controlled oscillator circuit for generating a high frequency reference signal, a divider circuit for dividing the high frequency signal into a lower frequency signal, an electro-optical time display such as an array of segmented liquid crystal elements, a display circuit for effecting display of different time intervals, a replaceable battery for powering the electronic components, and a manual switching means for selectively actuating the display circuit. The electronic components are assembled together in a timekeeping module commonly referred to as the watch movement.

The watch movement is mounted within a protective watch case which normally includes a generally tubular side wall, a transparent face cover secured to the upper peripheral edge of the side wall, and a bottom plate secured to the lower peripheral edge of the side wall. The watch movement is placed within the case with the time display means disposed beneath the transparent face cover. The side wall may be provided with a number of openings through which various knobs or push buttons extend to permit manual control of the function displayed by the display means. Some watch movements are designed so that the visual time display means will be illuminated only when the wearer wishes to know the time. In these watches the side wall of the case must be provided with an additional manually operated push button in order to illuminate the time display means.

The presence of several knobs or push buttons protruding from the side wall of a conventional electronic watch detracts from the aesthetically pleasing appearance of the watch case and contributes to the possibility of accidental damage to the vulnerable parts to which they are attached. Furthermore, because the conventional mechanical push-button switch necessarily includes a shaft projecting through the side wall, there is increased potential for water leakage and for wear failure. The presence of the shaft and knobs impose restrictions and limitations on the case styling and case thickness. The conventional mechanical switch is also subject to functional failure due to dirt buildup on its electrode contacts. Such switches are difficult to repair and normally must be returned to the manufacturer for repair at considerable inconvenience and expense to the owner.

A number of approaches have been tried to avoid the problems associated with the conventional mechanical switch. For example, an electronic watch having a magnetic switch is illustrated in U.S. Pat. No. 3,782,102. Magnetic buttons are located inside the watch case to eliminate the case holes, but such arrangements are expensive, space consuming and require a magnetic bar. In another approach, a plastic watch case with a flexible area on the case has been devised to activate switch contacts located inside the case. Such plastic cases have not gained widespread acceptance within the industry. Yet another approach is illustrated in U.S. Pat. No. 3,871,170 which discloses an inertial switch which is responsive to a predetermined movement of the wearer's arm for actuating a display circuit. Switching is accomplished by means of an electrically conductive metal sleeve in which is mounted a free floating electrically conductive metal ball. Such inertial switches are relatively expensive, space consuming, and in some situations are difficult to operate.

The introduction of electronic technology to the field of wrist watches has provided a new set of opportunities and problems. One of the opportunities includes the provision of a large array of new functions such as dual time zones, stop watches, alarms and date reminders in addition to the traditional displays of time, month-date, and seconds. A difficult problem as discussed above is that of making electrical contact to implement these new functions.

SUMMARY OF THE INVENTION

According to the present invention, a display circuit of an electrical timepiece which includes a timekeeping circuit and an electro-optical display is actuated by utilizing electrodes disposed on the exterior of the timepiece enclosure as electrode contacts of a switch which may be closed by simultaneously contacting the electrodes with a conductive body disposed outside of the case. In a preferred embodiment, the electrodes comprise a conductive face cover and a conductive case of the timepiece enclosure. The face cover may comprise a conventional optically transmissive crystal on which a conductive film has been deposited. A layer of electrical insulation is disposed between the case and the edge of the face cover to electrically isolate the face cover from the case and form a watertight seal at the interface thereof. A battery is coupled to energize the timekeeping means continuously and to selectively energize the display setting circuit when the case and face cover are simultaneously contacted by a conductive body. The battery is electrically connected in series with an exterior conductive surface portion of the case and with the display setting circuit, and the display setting circuit is electrically connected in series with the conductive material deposited on the face cover and with the battery. The display setting circuit is preferably operably responsive to a predetermined current range corresponding generally to the magnitude of the current conducted by the battery through the body of a person wearing the timepiece whereby the person wearing the timepiece with the exterior conductive surface of the case disposed in electrical contact with the skin of his wrist or with some other part of his body can actuate the display circuit by touching the accessible exterior conductive surface portion of the face cover with his finger or with some other part of his body.

The novel features which characterize the invention are defined by the appended claims. The foregoing and other objects, advantages and features of the invention will hereinafter appear, and for purposes of illustration, but not of limitation, an exemplary embodiment of the invention is shown in the appended drawing.

DETAILED DESCRIPTION

Figure 1:
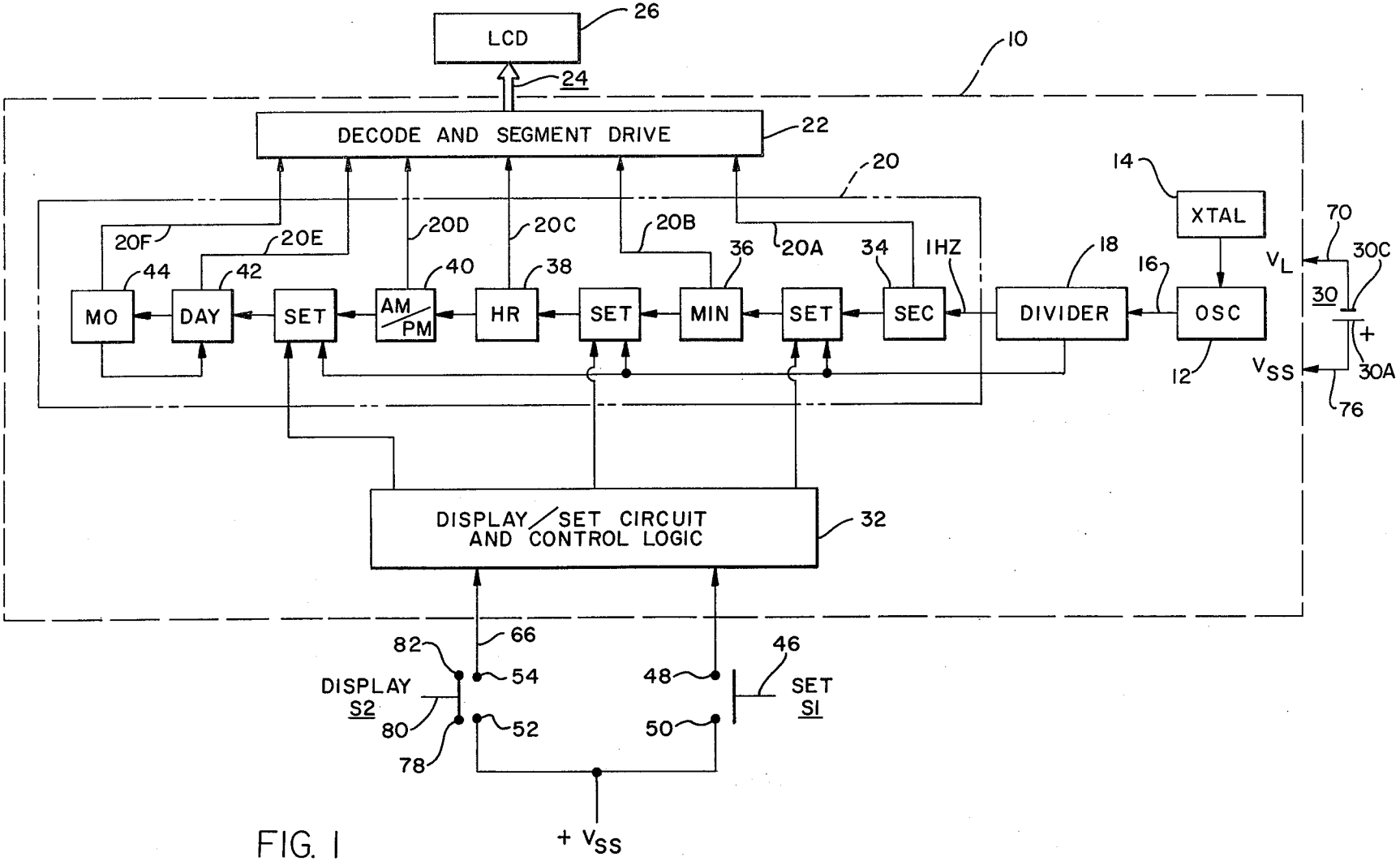
FIG. 1 is a block diagram which illustrates the principal components of an electronic watch in which the present invention has been incorporated.
Figure 5:
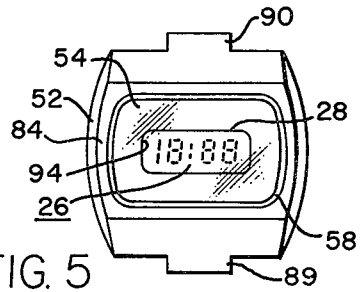
FIG. 5 is a plan view of the electronic watch shown in FIG. 2.

Referring now to FIG. 1 of the drawing, the principal components of an electronic timekeeping module or watch movement 10 are illustrated. The timekeeping module 10 is enclosed within enclosure means comprising generally a case and a face cover mounted on the case. The module 10 is essentially conventional in design in that it includes a crystal oscillator circuit 12 which typically employs a quartz crystal 14 to generate a standard reference output signal 16. A divider circuit indicated generally by the reference numeral 18 divides or reduces the high frequency reference signal 16 to a lower frequency, usually one Hz. The divider circuit 18 is coupled to a counter circuit 20 which develops a plurality of timing signals 20A–20F which correspond to timing signals for displaying seconds, minutes, hours, a.m./p.m., day, and month, respectively. These signals are coupled to a solid-state encoder 22 which is operable to convert the signals 20A–20F into a group 24 of timekeeping signals for driving an electro-optical display 26. The electro-optical display 26 may be an array of segmented liquid crystal elements grouped together in a plurality of indicia 28 for separately indicating different time intervals, for example as illustrated in FIG. 5. An electrical energy source 30 is coupled to continuously energize the timekeeping module 10. The electrical energy source 30 is preferably a replaceable battery having a suitable contact potential, for example 1.5 volts d.c.

The battery 30 is also coupled to selectively energize a display/set and control logic circuit 32. The timing signal outputs 20A–20F are typically coded into binary decimal signals which, in turn, are converted by the decoder and segment drive unit 22 into an intelligible timekeeping code for the liquid crystal display 26.

The output signal 16 of the oscillator 12 is typically 32.768 kHz. This high frequency reference signal 16 is reduced to one Hz by the divider 18. This signal is divided by 60 in a "seconds" counter 34 which includes a reset capability. The signal is divided again by 60 in a "minutes" counter 36 which includes a reset capability and is divided again by 12 in a "hours" counter 38. The counters 36–44 provide binary coded decimal (BCD) outputs to the decoded driver 22 which includes a plurality of seven segment driver stages for indicating minutes in the "ones" place, and an identical stage for indicating minutes in the "tens" place, and an identical stage for indicating hours in the "ones" place, and a single segment stage for indicating hours in the "tens" place. The corresponding display character for the latter stage is either "one" or blank in a twelve hour display, hence only one segment need be driven. Another single segment driver stage, which may be identical to the other stages actuates the colon and receives a one Hz input causing the colon to flash at a one Hz rate.

Since the liquid crystal segments normally require a higher driving voltage than is provided by the battery 30, a voltage booster circuit (not shown) elevates the display driving voltage supplied to the driver stages of the counter 22. The display/setting circuit and control logic unit 32 is operable to change or update the displayed time. The control unit 32 provides the capability to selectively advance the minutes 36, hours 38, day 42, and month 44 counters at a one Hz rate, and/or to reset the "seconds" counter 34 to zero by manipulation of external switches S-1, S-2.

Since the timekeeping module 10 need be set relatively infrequently, the switch S-1 may be the exterior manually operated type which includes a push button 46 aligned with a pair of pressure actuated contact electrodes 48, 50 which are disposed within the interior of the watch case 52. The push button 46 is preferably mounted flush with the outside wall of the watch case 52 and may be the type which is actuated by the pressure of a pointed instrument.

Five setting states and two normal operating states are included in the setting sequence. Each state is uniquely identified with hours, minutes, and seconds being distinguished from month and date by the colon. In the hour-set mode the fourth digit is either an A or a P to indicate a.m. or p.m. Only the set input is required to select the desired setting state. Connecting the set input repeatedly to the voltage potential $V_{SS}$ of the battery 30 causes the circuit to advance through its set and run states at the rate of one state per set switch closure. When the display is in the desired setting state the display button is used to set the displayed quantity. Connecting the display input to $V_{SS}$ causes the selected quantity (month, date, hours or minutes) to be advanced at the rate of one unit per second. In all setting states, timekeeping is not interrupted nor is any counter advanced until the display circuit 32 is actuated. At all setting states except minutes, only the quantity being displayed can be changed and that change cannot happen until the display switch S-2 is actuated. In a set minute state, seconds are reset to zero and are held when minutes are advanced. After minutes are set and the display is returned to the run mode, the colon is held on. Seconds counting is resumed from zero by actuating the display switch S-2.

In a typical arrangement, hours and minutes are displayed continuously, with month and date displayed upon interrogation by actuating the display switch S-2. However, the timekeeping module 10 may be programmed to provide a continuous display alternating between time and date. Operation in either the normal or alternating display mode is selected by the set switch S-1 during the initial setting of the watch. When operating in the normal mode, the display initially shows hours and minutes. The absence of a colon distinguishes the month/date display from the hour/minute and seconds display. The seconds display is obvious as only the last two digits are used and the display is incrementing once per second. The data is displayed in the normal operating mode by actuating the display switch S-1 until the readout changes to month-date. The circuit will read out month-date for two to three seconds and will return to the hours-minutes readout automatically.

Figure 2:
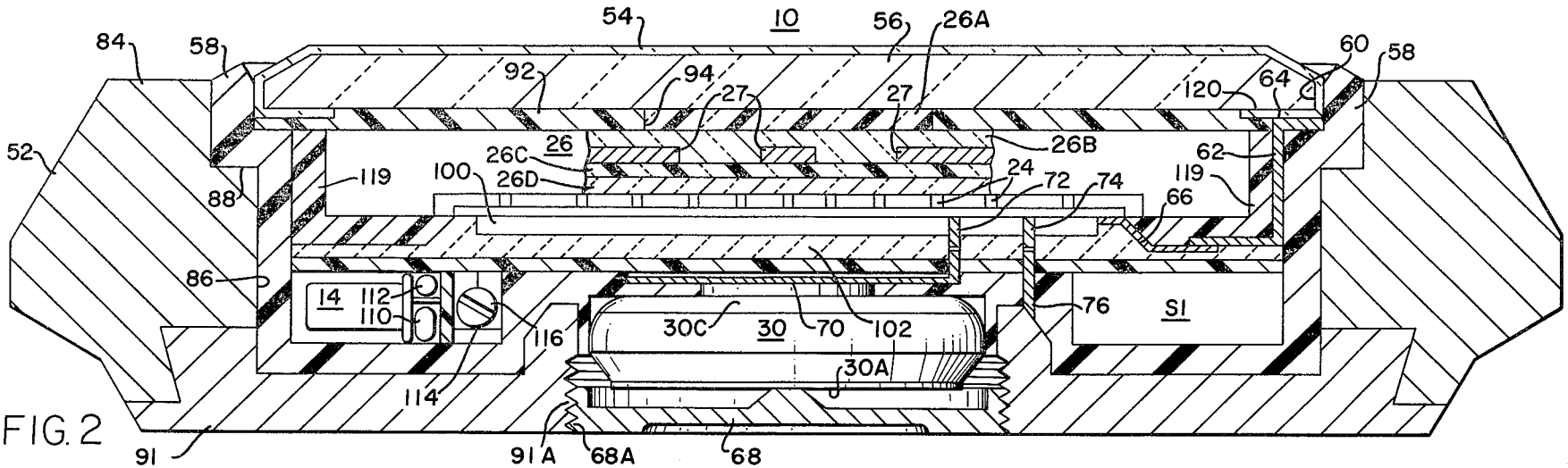
FIG. 2 is a partial sectional view which illustrates the physical details of the electronic watch shown in FIG. 1.

It will be appreciated from the above discussion that the display switch S-2 will be actuated much more often than the set switch S-1. It is necessary to actuate it repetitively in order to effect sequential and separate display of different time intervals. Therefore it should be readily accessible to the user, reliable, and easy to operate as compared to the conventional switches such as the set switch S-1. The structure of an improved display switch S-2 which meets these requirements is illustrated in FIG. 2 of the drawing. According to an important feature of the invention, the switch S-2 comprises a first electrode contact formed by the case 52 which is fabricated from a conductive material such as metal, and a second electrode contact which is formed by a conductive exterior surface portion 54 of an optically transmissive face cover 56. The conductive surface portion 54 of the face cover is electrically isolated from the conductive watch case 52 by means of a layer 58 of electrical insulation which is disposed between the case 52 and the edge 60 of the face cover. The layer 58 of electrical insulation serves a dual purpose of forming a watertight seal at the interface of the edge 60 of the face cover 56 and watch case 52. The conductive surface 54 is preferably an extremely thin film of conductive material such as a metal oxide formed in a transparent metallization deposit. The thickness of the conductive layer 54 is greatly enlarged in the drawing for purposes of illustration, and in practical embodiments the conductive layer will not exceed a few hundred angstroms in thickness.

The conductive exterior surface portion 54 is connected to the display circuit 32 by means of a conductor 62 which is bonded or otherwise disposed in electrical contact with the conductive layer 54 at an interior point 64 on the underside of the face cover 56. The conductor 62 is also electrically joined by welding or soldering to an input lead 66 of the display circuit 32. The annode 30A of the battery is disposed in electrical contact with a removable back portion 68 of the conductive watch case 52. The cathode 30C of the battery 30 is disposed in electrical contact with a resilient conductor 70 which is connected to a power node 72 of the watch module 10. A second power node 74 of the watch module 10 is connected to receive current from the annode 30A by means of a conductor 76 which is electrically connected to the case 52.

The battery 30 is coupled to energize the timekeeping module 10 continuously by means of the conductors 70, 76. However, the display circuit 32 is selectively energized through the switch S-2 so that the display circuit 32 may be selectively actuated to change the operating mode of the timekeeping module 10 by establishing a conductive path between the case 52 and the exterior conductive surface portion 54 of the face cover by simultaneously contacting the exterior conductive surface portions of the face cover and of the case with a conductive body disposed outside of the case, thereby providing a path for the flow of current from the battery 30 through the input 66 of the display circuit 32.

The battery 30 is electrically connected in series with the conductive watch case 52 and with the display circuit 32. The display circuit 32 is electrically connected in series with the conductive surface portion 54 of the face cover 56 and in series with the battery 30. In a preferred embodiment, the display circuit 32 is operably responsive to a predetermined current range which corresponds generally to the magnitude of the current conducted by the battery 30 through the body of a person wearing the watch case 52 in contact with a portion of his body, whereby a person wearing the timepiece with the exterior conductive surface of the case 52 disposed in electrical contact with the skin of his wrist 78 (FIG. 1) or some other part of his body 80 can actuate the display circuit 32 by touching the accessible exterior conductive surface portion 54 of the face cover 56 with his finger 82 or with some other part of his body. Thus the watch module 10 can be interrogated rapidly and easily to effect the successive and separate display of different time intervals as rapidly as a person can move his index finger. The reliability of this switching arrangement is excellent because there are no moving mechanical parts involved.

The watch case 52 is conventional in construction and includes at least an accessible exterior portion which is conductive in order to carry out the invention. In most instances it will be preferable for ease of construction to have the watch case constructed of all metal parts and therefore be completely conductive. However, the invention may be carried out by including a single isolated conductive case portion which is accessible from the exterior of the case in an otherwise completely nonconductive case structure. It is anticipated, however, that the watch case 52 will be of the all metal, completely conductive type which includes a bezel 84 which holds the face cover 56.

The watch case 52 includes an interior bore 86 which defines a cylindrical wall open to the back of the watch case and a shoulder 88 beneath the bezel. The case 52 is also provided with ear sets 89, 90 (FIG. 5) for the attachment of a watch band. Alternatively, a ring for the attachment of a watch fob or a chain can be employed if the case is to be carried for pocket service or suspended from a part of a person's clothing. The case 52 is closed by a conductive back portion 91 which is connected to the case in a snap-in compressive clamping operation with adequate sealing being provided by a sealing ring (not shown). Within the watch case 52, a dial plate 92 is positioned within the bore 86 and can carry any convenient ornamental configuration, but at least the center of the dial plate must have a window 94 to permit the electro-optical display 26 to be viewed. The back plate 91 and the battery hatch 68 are provided with mating screw threads 91A, 68A which permits the convenient insertion and removal of the battery 30 from the watch case 52. Seal rings (not shown) are clamped between the hatch cover and back plate 91 to provide the desired hermetic sealing. Electrical contact from the annode 30A of the battery 30 through the battery hatch 68 is provided by the metal-to-metal contact of the mating threads 68A, 91A.

The layer of insulation 58 may be a gasket comprising a dielectric elastomeric material such as a synthetic polymer material having hermetic and dielectric characteristics.

The electro-optical display 26 may be any of the various types suggested in the prior art such as liquid crystal, electro-phoretic, light emitting diode, or electro-chromic, all having the common characteristic that the time indicating characters are made visible on a viewing surface by providing suitable coded electrical signals to the display. The type of display shown in the preferred embodiment is a liquid crystal display of the "field-effect" type which is commercially available and which comprises a laminated construction of a transparent polarizing layer 26A, a transparent glass layer 26B, another transparent polarizing layer 26C, and a reflecting layer 26D. A chamber between the glass layers 26B and 26C contains liquid crystal material 27 suitable for display use in the twisted-nematic field-effect mode. Separately energizable electrodes (not shown) are connected by means of the conductors 24 which are electrically connected to the decode and segment drive unit 22.

Figure 3:
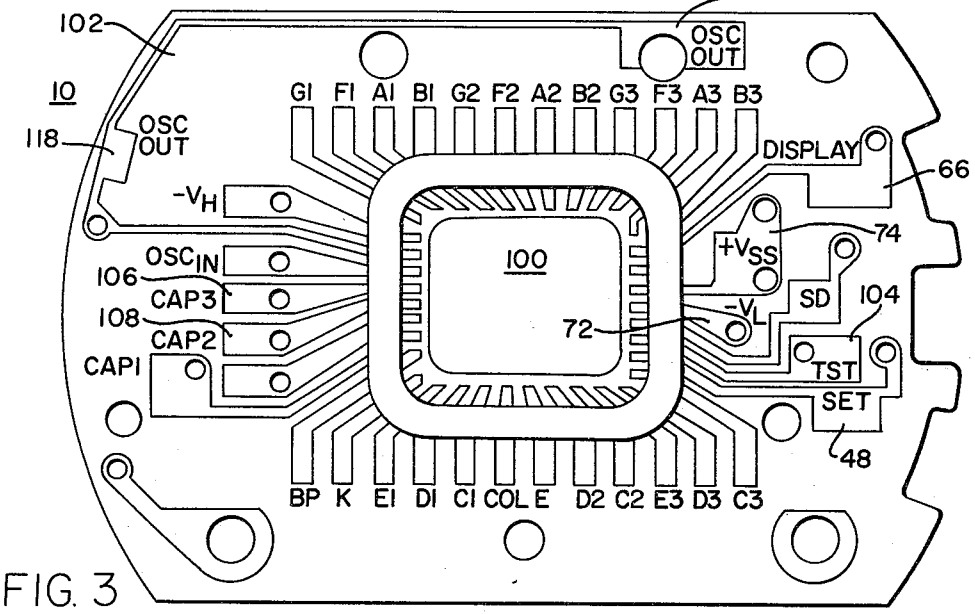
FIG. 3 is a simplified layout view of an integrated timekeeping circuit assembly.

The principal components of the watch module 10 are fabricated in a single integrated circuit "chip" 100 preferably including silicon gate CMOS circuitry designed to drive the liquid crystal display 26. The functional blocks for the amplifiers, dividers, counters, drivers and other logic elements illustrated in FIG. 1 of the drawing may be carried out by techniques well known to those skilled in the art using CMOS circuits to reduce power consumption. Referring to FIG. 3 of the drawing, the integrated circuit chip 100 is secured to a flat substrate 102 with printed circuits applied to both sides employing single layer thick film printing techniques. The substrate 102 carries most of the electrical contact terminals for the module. Additional contacts (not shown) are associated with the crystal 14 and oscillator circuit 12 which are appropriately insulated from the watch case 52 and from the electrical terminals on the substrate 102. The precise circuit arrangement of the terminals or printed circuit leads disposed on the substrate 102 are not material to the present invention, so no attempt will be made to describe the arrangement in detail. In general, various printed circuit terminals, such as terminal 104, extend from the integrated circuit chip 100 to conductive inserts which are exposed on both sides of the substrate to form "test points" from making external tests of the circuit components. Other terminals, for example the terminals 66 and 48, extend to the switches S-1 and S-2 as discussed above. Other printed circuit terminals are connected to external components mounted beneath the substrate, such as terminals 106, 108 which are connected to chip capacitors 110 and 112. The remaining terminals are connected to the electro-optical display 26. A variable impedance element, either a resistor or a capacitor 114 which includes an adjustable wiper arm 116 is connected to a terminal 118 to trim the frequency of the oscillator 12. The electro-optical display 26 is suitably insulated from the conductor 62 and from the leads of the substrate 102 by a layer of insulation 119. The chip 100 is suitably encapsulated and hermetically sealed in a suitable silicon rubber potting compound (not shown).

An important feature of the invention is the provision of the watch crystal or face cover 56 as an isolated conductive electrical terminal. The entire face cover 56 may comprise a unitary body of electrically conductive, optically transmissive material. Alternately, the face cover 56 may comprise a unitary body of optically transmissive material on which a film 54 of electrically conductive material is deposited. The electrically conductive film is preferably optically transmissive. Such a film may be deposited on a glass face cover crystal 56 by exposing a surface portion of the face cover 56 to a source of metal atoms which are sputtered by the application of RF energy through an electrode arrangement. The film need only be a few hundred angstroms in thickness and may comprise a metal oxide such as indium oxide or tin oxide or mixtures thereof. Other metallic conductors can also be deposited by numerous other standard metallization techniques.

The entire conductive portion of the face cover need not be optically transmissive, and when this is the case, an optically transmissive window must be provided over the central portion of the face cover so that the electro-optical display may be viewed. To implement the invention, it is only necessary that the conductive film be deposited on an exterior surface portion of the face cover which is accessible when the face cover 56 is mounted to the case 52. It is also necessary that electrical contact with the exterior conductive surface portion be made to some interior point within the module. This may be conveniently accomplished by applying the conductive film 54 around the edge 60 of the face cover 56 and over an interior surface portion of the face cover 56 as shown in FIGS. 2 and 5. In this arrangement, the electrically conductive film 54 is deposited in a continuous layer over an accessible exterior surface portion, the peripheral edge 60, and a relatively inaccessible interior surface portion 120 of the face cover 56 thereby defining a continuous electrical path from an accessible point on the exterior surface of the face cover 56 to a relatively inaccessible point on the interior surface thereof.

Figure 4:
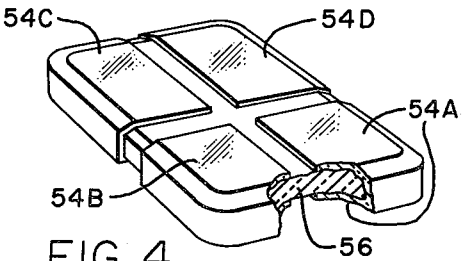
FIG. 4 is an isometric view, partly in section, of a watch face cover constructed according to the teachings of the present invention.

In some instances it may be desirable to provide the face cover 56 with different, electrically isolated areas which may be used to initiate different functions if desired. Such an arrangement is shown in FIG. 4 of the drawing in which electrically isolated areas 54A, 54B, 54C and 54D are symmetrically arranged about the principal center lines of the face cover 56.

The display switching arrangement of the present invention takes advantage of the fact that the integrated circuitry of the electronic watch module 10 may be activated by extremely low current signals on the order of a few microamperes and can be actuated by closing a contact through a relatively high resistance, on the order of two to five megohms. This means that the switching path can be extended through the body of the person wearing the timepiece. The switching circuit is implemented by utilizing the face cover crystal 56 as an isolated electrical terminal in combination with the conductive watch case 52. The face cover crystal 56 is a separately manufactured part and must be inserted into the case 52 in a separate operation. Thus it is relatively easy to electrically isolate the crystal from the case. To serve its purpose, the face over crystal 56 must be electrically conductive. Conductivity may be obtained by numerous standard metallization techniques, some of which have been discussed above. A person wearing an electronic wrist watch constructed according to the teachings of the present invention need only touch a fingertip to the conductive part of the face cover crystal to trigger the display of a different timekeeping function. The actuating circuit can also be completed by simultaneously touching any metallic part of the watch including the watchband.

The advantages of the present invention include its low cost, the greater styling freedom it gives to the case designer, the small amount of space required inside the case used by the switching mechanism, the increased life and reliability of the contact, and the additional benefit that the invention inproves rather than compromises the waterproof nature of the case.

Figure 6:
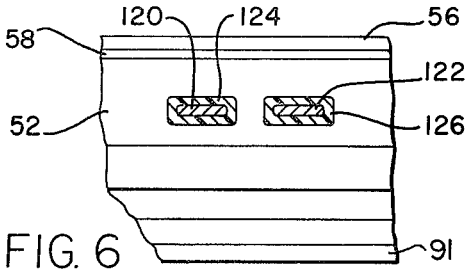
FIG. 6 is an elevation view, partly in section, of an alternate electrode arrangement.
Figure 7:
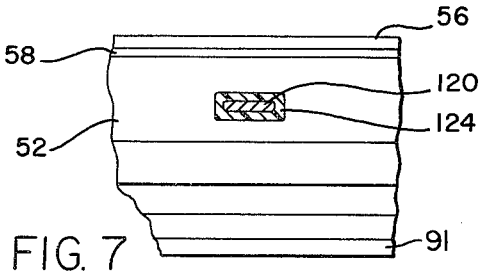
FIG. 7 is a view similar to FIG. 6 of yet another electrode arrangement.

According to the invention in its broadest aspects, the first and second electrode contacts may be located on other exterior portions of the timekeeping enclosure and may assume other physical embodiments. For example, both electrodes may be disposed on the watch case 52 as illustrated in FIGS. 6 and 7 of the drawing. In FIG. 6, electrodes 120, 122 are disposed on an external side surface of the case 52 and are insulated therefrom by surrounding insulation 124, 126. A single electrode 120 is required when the case 52 comprises one of the electrodes as shown in FIG. 7. Both of these arrangements permit actuation by conduction through the finger alone.

Figure 8:
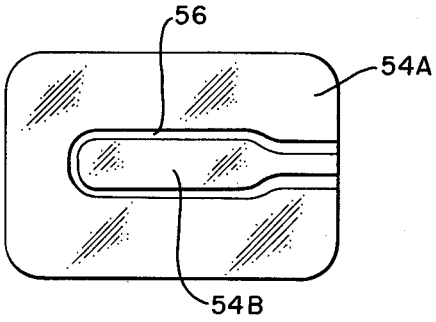
FIG. 8 is a plan view of a watch face cover having a pair of conductive film electrodes arranged in a symmetrical pattern.
Figure 9:
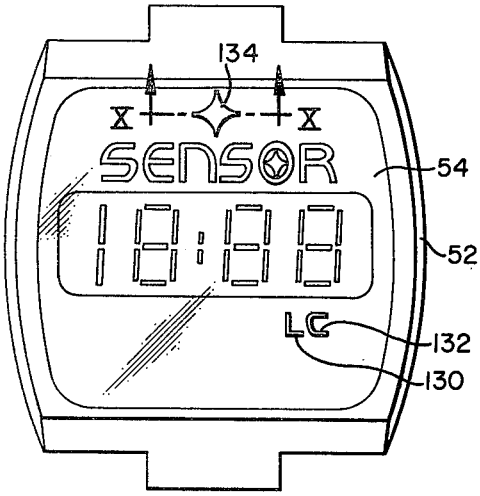
FIG. 9 is a plan view of a watch having a face cover which includes electrodes comprising a conductive logo and a conductive symbol.

In an alternate arrangement, both electrodes may be on the face cover 56 as shown in FIGS. 8 and 9. In FIG. 8, both electrodes are embodied by conductive film deposits 54A, 54B arranged in a concentric pattern on exterior surface portions of the face cover. In yet another arrangement (FIG. 9), the electrodes comprise a spaced pair of symbols 130, 132 which are disposed on the external surface of the face cover and are electrically connected to the actuating circuit 32 by means of a conductive stud (not shown) similar to the arrangement shown in FIG. 10. These arrangements also permit actuation by conduction through the finger alone.

Figure 10:
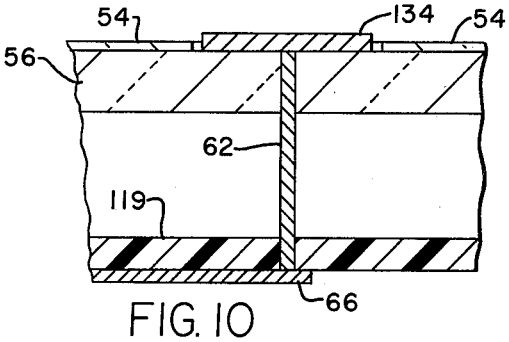
FIG. 10 is a sectional view taken along the line X—X of FIG. 9.

A single conductive body, which may be a logo symbol 134 such as shown in FIG. 9 may be used in combination with either a surrounding conductive film 54 (FIG. 10) when both electrodes are mounted on the face cover, or with the logo 134 in combination with a nonconductive face cover 56 and a conductive case 52. A conductive stud 62 interconnects the logo 134 to the input 66 of the actuating means 32 as shown in FIG. 10.

Figure 11:
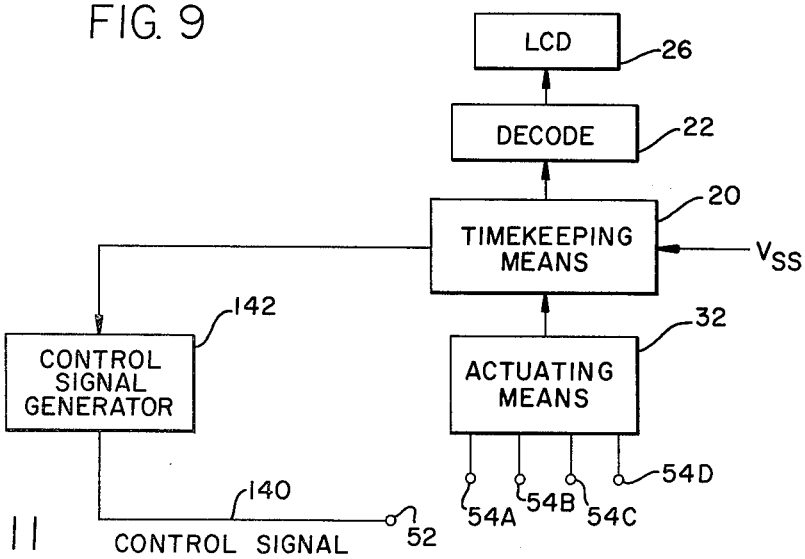
FIG. 11 is a block diagram similar to FIG. 1 which illustrates an alternate actuating arrangement.

The actuating means 32 can be actuated by means other than the DC battery 30. In a preferred embodiment, as shown in FIG. 11, a control signal 140 is generated by a control signal generator 142 which is preferably a subassembly of the timekeeping means 20. The control signal may be alternating current, direct current, pulsed, coded, or a function of voltage only for use with CMOS circuitry.

The control signal 140 is preferably a pulse coded signal and the actuating means 132 is preferably responsive only to the pulse control signal 140 to prevent inadvertent actuation of the time-keeping means 20 by static electrical discharges.

Referring again to FIG. 11, it may be desirable to utilize a conductive case 52 as one electrode in combination with a plurality of electrodes 54A–D disposed on the face cover 56, for example as shown in FIG. 4. In this arrangement, the electro-optical display 26 preferably includes a plurality of indicia for separately indicating different time intervals. The actuating means is provided with a plurality of input circuits for separately receiving the control signal 140 through the conductive film deposits 54A–D, and includes an output circuit for separately actuating the indicia of the display in response to the control signal. This arrangement is useful for simultaneously displaying separate time intervals, for example local hour/minute versus the corresponding hour/minute of a different time zone.

Although certain preferred embodiments of the invention have been described in detail, it should be understood that various changes, substitutions, and alterations can be made therein without departing from the spirit and scope of the invention as defined by the appended claims.

What is claimed is:

1. An electrical timepiece comprising:

enclosure means including a case and an optically transmissive, non-conductive face cover supported on the case;

a first conductive electrode disposed on an exterior portion of the enclosure means.

a second conductive electrode including a conductive stud projecting through the face cover, the first and second conductive electrodes being electrically isolated with respect to each other;

timekeeping means enclosed within the enclosure means including an electro-optical display, means for generating a control signal, and electrical actuating means connected to the electro-optical display having an input for receiving the control signal and an output connected to actuate the display in response to the control signal; and, the first electrode being electrically connected to the generating means to receive the control signal and the second electrode being electrically connected to the input of the actuating means, whereby the display is selectively actuated by simultaneously contacting the first and second electrodes with an electrical coupling medium disposed outside of the enclosure means.

2. The electrical timepiece as defined in claim 1 including an optically transmissive, conductive film deposited on the exterior surrface of the face cover, the conductive stud being electrically isolated with respect to the conductive film.

3. An electrical timepiece comprising:

enclosure means including a case and an optically transmissive, nonconductive face cover;

a first conductive electrode disposed on a first exterior surface portion of the face cover;

a second conductive electrode disposed on a second exterior surface portion of the face cover, the first and second conductive electrodes being electrically isolated with respect to each other and comprising first and second conductive studs each projecting through the face cover;

timekeeping means enclosed within the enclosure means including an electro-optical display, means for generating a control signal, and electrical actuating means connected to the electro-optical display having an input for receiving the control signal and an output connected to actuate the display in response to the control signal; and, the first electrode being electrically connected to the generating means to receive the control signal and the second electrode being electrically connected to the input of the actuating means, whereby the display is selectively actuated by simultaneously contacting the first and second electrodes with an electrical coupling medium disposed outside of the enclosure means.

* * * * *